US008261752B2

(12) United States Patent
Bao

(10) Patent No.: US 8,261,752 B2
(45) Date of Patent: Sep. 11, 2012

(54) CRANK TYPE AUTOMATIC CIGARETTE TUBE INJECTOR

(76) Inventor: Fan Bao, City of Industry, CA (US)

( * ) Notice: Subject to any disclaimer, the term of this patent is extended or adjusted under 35 U.S.C. 154(b) by 483 days.

(21) Appl. No.: 12/584,110

(22) Filed: Aug. 31, 2009

(65) Prior Publication Data

US 2010/0229880 A1 Sep. 16, 2010

Related U.S. Application Data

(60) Provisional application No. 61/209,953, filed on Mar. 11, 2009.

(51) Int. Cl.
*A24C 5/00* (2006.01)

(52) U.S. Cl. ..... 131/70; 131/75

(58) Field of Classification Search ..... 131/70–75
See application file for complete search history.

(56) References Cited

U.S. PATENT DOCUMENTS

| | | | | |
|---|---|---|---|---|
| 2,551,095 | A * | 5/1951 | Chaze | 222/162 |
| 2,731,971 | A | 1/1956 | Kastner | |
| 3,124,141 | A | 3/1964 | Seitter | |
| 3,693,630 | A | 9/1972 | Kastner | |
| 3,721,248 | A | 3/1973 | Paynter | |
| 3,741,220 | A | 6/1973 | Meinunger | |
| 3,886,952 | A | 6/1975 | Kastner | |
| 4,167,948 | A | 9/1979 | Moscovitch | |
| 4,215,705 | A | 8/1980 | Marcil | |
| 5,088,506 | A | 2/1992 | Kastner | |
| 6,557,560 | B2 | 5/2003 | Kastner | |
| 7,905,235 | B2 * | 3/2011 | Patel | 131/57 |
| 2008/0156335 | A1 | 7/2008 | Bajouet | |
| 2009/0183741 | A1 | 7/2009 | Lin | |

* cited by examiner

*Primary Examiner* — Richard Crispino
*Assistant Examiner* — Dionne Walls Mayes
(74) *Attorney, Agent, or Firm* — Raymond Y. Chan; David and Raymond Patent Firm

(57) ABSTRACT

A crank type cigarette tube injector, for injecting tobacco leaves into a hollow cigarette paper tube, includes a housing having a tobacco cavity for the tobacco leaves disposing thereat, and a feeding opening for the cigarette paper tube alignedly supporting thereat, an electric motor, having an output shaft, received in the housing, and a cigarette filling arrangement, which is driven by the electric motor via the output shaft for feeding the tobacco leaves to the cigarette paper tube through the feeding opening of the housing. The crank type cigarette tube injector not only can make a tight and evenly injection to have a better quality of cigarettes, but also has a length lesser than two cigarette lengths of the cigarette paper tube such that it has a reduce dimension and improved portability.

25 Claims, 8 Drawing Sheets

CRANK TYPE AUTOMATIC CIGARETTE TUBE INJECTOR

CROSS REFERENCE OF RELATED APPLICATION

This is a non-provisional application of a provisional application having an application No. 61/209,953 and a filing date of Mar. 11, 2009.

BACKGROUND OF THE PRESENT INVENTION

1. Field of Invention

The present invention relates to a cigarette tube injector, and more particularly to a cigarette tube injector which not only can make a tight and even injection to have a better quality of cigarettes, but also has a compact size for enhancing the portability of the cigarette tube injector.

2. Description of Related Arts

The cigarettes consumed by people are normally manufactured by factories and are sold in market. A cigarette is a paper wrapped tube stuffed with finely cut tobacco leaves. Generally the tobacco leaves are cured and processed with addictives. There are many tastes and brands of cigarettes people can select because of the different types of tobacco leaves, different cure processes and addictives. But still some people want to smoke their own tobaccos.

For those people using their own tobaccos, they have to prepare their own cigarettes by rolling the paper to wrap their cut tobacco leaves inside. Doing this by hands takes a lot of time, and it is also difficult to stuff the tobacco leaves with a uniform and proper compactness. If the tobacco leaves are wrapped too compressed, it is difficult to smoke; if the tobacco leaves are wrapped too loose, it is easy to drop the tobacco leaves 40, and get the cigarette extinguished.

Currently there are machines can help people to make cigarettes with their own tobaccos, but there are some problems preventing these machine be used conveniently. Some of these machines still need the user to use hands. For example, a manual crank-type machine can be operated manually by filling the tobacco leaves into the crank nozzle such that when the crank nozzle is inserted into the cigarette paper tube, the tobacco leaves loaded therein. The advantage of the manual crank-type machine is that the tobacco leaves will not be shred when the tobacco leaves are loaded in the cigarette paper tube. However, one of the drawbacks of the manual crank-type machine is that the injection is not automatic. The user has to use both hands and provides force. It is not convenient to use. Another drawback is that the tobacco leaves cannot be evenly loaded within the cigarette paper tube such that compactness of the cigarette is not uniform.

Some machines are driven by electric power. The tobacco leaves are injected automatically. But the problem is the size of this kind of machine is large. Particularly, the length of this kind of machine has to be more two times of the length of a cigarette. For example, such automatic machine generally has a chamber to contain tobaccos which will be injected into the cigarette paper tube. In order to fulfill the cigarette paper tube, the volume of the chamber is the same or little larger than the cigarette paper tube, and the length of the chamber is the same or a little longer than the length of the cigarette paper tube. At one end of the chamber is a nozzle which is inserted into one open end of the cigarette paper tube. At the other end of the chamber is a piston to inject the tobaccos inside the chamber into the paper tube through the nozzle. The piston is driven by a driving shaft, for example, as worm shaft. Because the piston will slide through the chamber from one end to another to push the tobacco leaves into the cigarette paper tube, the driving shaft at least has to be the same length as the length of the chamber. When the tobacco leaves are loaded into the chamber, the driving shaft has to stay outside the chamber and align with the chamber longitudinally. Considering the driving mechanism, the total length of this machine must be longer than the length of the driving shaft plus the length of the chamber which is at least two times of the length of a cigarette.

Another type of automatic machine incorporates with a spiral nozzle for delivering the tobacco leaves into the cigarette paper tube. However, when the spiral nozzle is rotated for delivering the tobacco leaves, the tobacco leaves will be shred into small pieces within the cigarette paper tube. Therefore, when the cigarette is lightened, the cigarette ash cannot be held properly while smoking. It is a hassle for the smoker to hold the cigarette steadily to prevent the cigarette ash from falling everywhere. In other words, if the cigarette ash can be held properly by not shredding the cigarette leaves in the cigarette paper tube, the smoker can easily and precisely flick the cigarette ash in the ashtray.

SUMMARY OF THE PRESENT INVENTION

An object of the present invention is to provide an automatic cigarette tube injector, which is an automatic crank type cigarette maker to pack the tobacco leaves within the hollow cigarette paper tube with a uniform and proper compactness.

Another object of the present invention is to provide an automatic cigarette tube injector, which can load the tobacco leaves within the hollow cigarette paper tube without shredding the tobacco leaves.

Another object of the present invention is to provide an automatic cigarette tube injector which can make a tight and even injection to have a better quality of cigarettes.

Another object of the present invention is to provide an automatic cigarette tube injector which is portable.

Another object of the present invention is to provide an automatic cigarette tube injector which injects tobacco leaves automatically.

Another object of the present invention is to provide an automatic cigarette tube injector having a small size.

Another object of the present invention is to provide an automatic cigarette tube injector which length is close to the length of a cigarette.

Another object of the present invention is to provide an automatic cigarette tube injector which compresses the tobacco leaves before injection.

Another object of the present invention is to provide an automatic cigarette tube injector which provides a feeding member to remove an excess tobacco and a motor-powered feeding crank to inject the tobacco directly into the cigarette tube without damaging it, resulting that tobacco is tightly and evenly injected and held in the tube to provide a better quality of cigarettes.

In order to accomplish the above objects, the present invention provides an automatic cigarette tube injector for injecting tobacco leaves into a hollow cigarette paper tube, comprising:

a housing having a tobacco cavity for the tobacco leaves disposing thereat, and a feeding opening for the cigarette paper tube alignedly supporting thereat, wherein a length of the housing is lesser than two cigarette lengths of the cigarette paper tube;

an electric motor, having an output shaft, received in the housing; and a cigarette filling arrangement, which is driven by the electric motor via the output shaft for feeding the tobacco leaves to the cigarette paper tube through the feeding opening of the housing.

These and other objectives, features, and advantages of the present invention will become apparent from the following detailed description, the accompanying drawings, and the appended claims.

DETAILED DESCRIPTION OF THE PREFERRED EMBODIMENT

Figure 1:
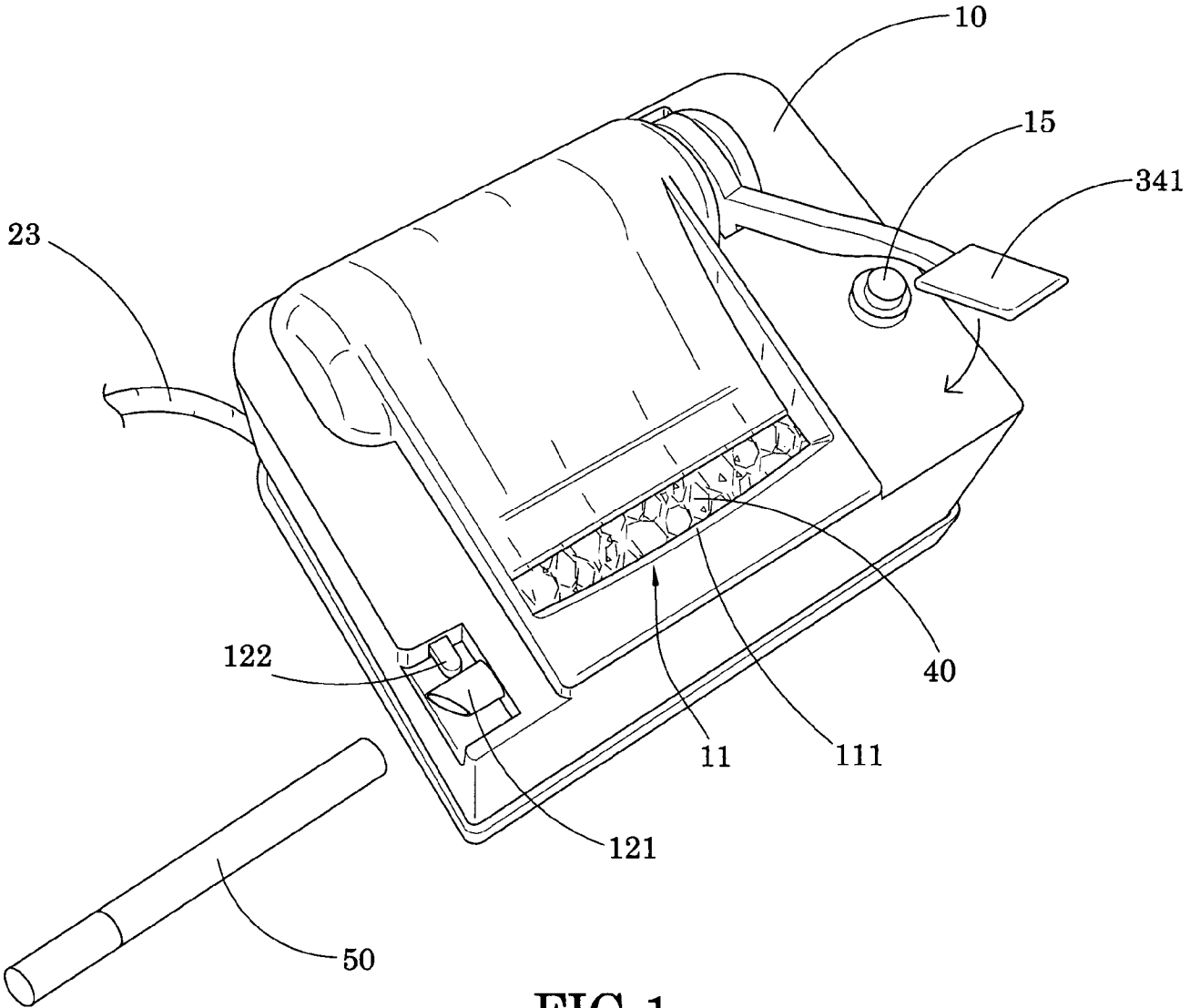
FIG. 1 is a perspective view of a cigarette tube injector according to a preferred embodiment of the present invention.

Referring to FIGS. 1 to 6 of the drawings, the cigarette tube injector according to a preferred embodiment of the present invention is illustrated, wherein the cigarette tube injector is adapted for loading tobacco leaves 40 into a cigarette paper tube 50. The cigarette tube injector comprises a housing 10, an electric motor 20, and a cigarette filling arrangement 30.

Figure 2:
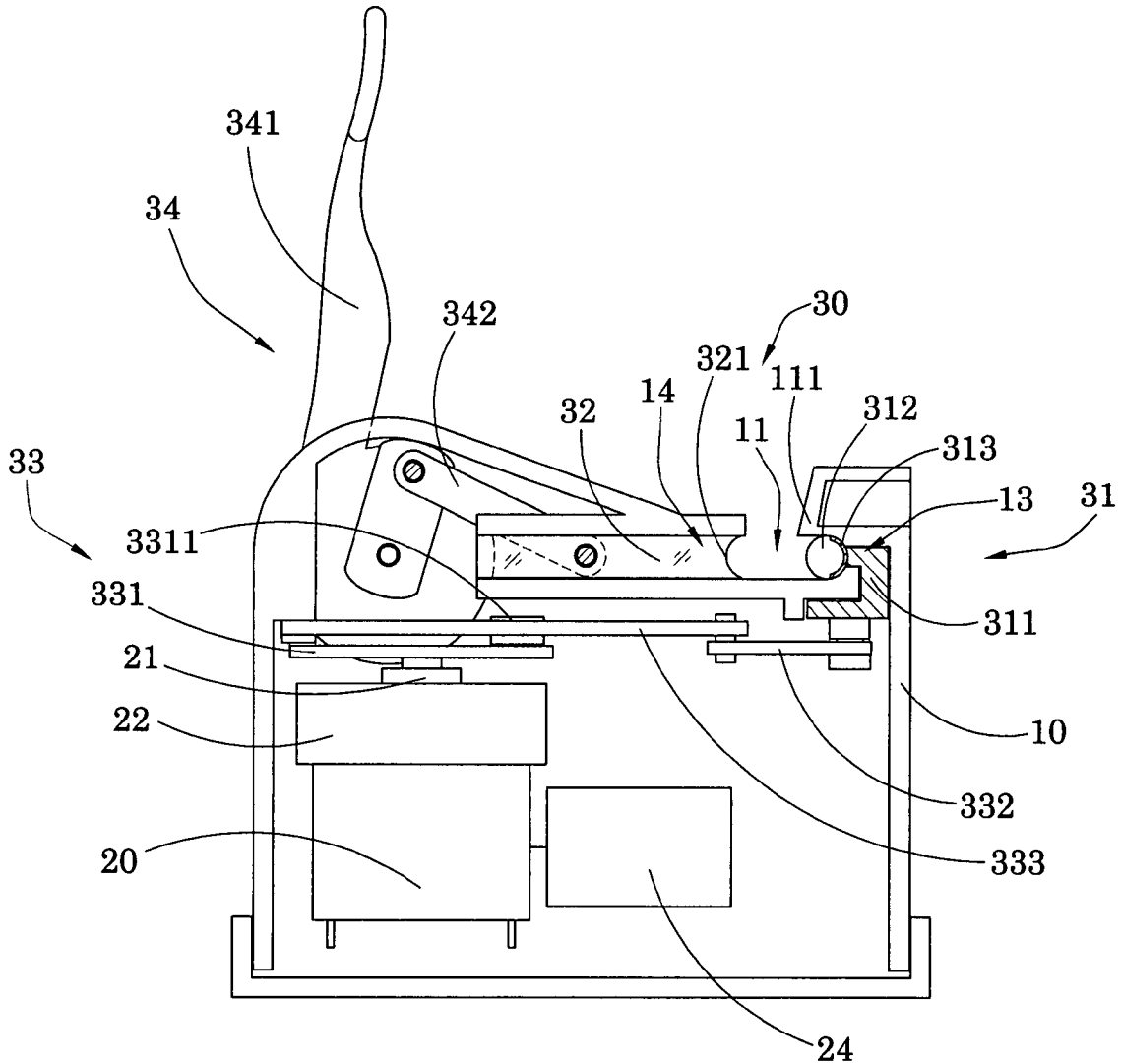
FIG. 2 is a sectional view of the cigarette tube injector according to the above preferred embodiment of the present invention, illustrating the feeding member at the initial position.
Figure 3:
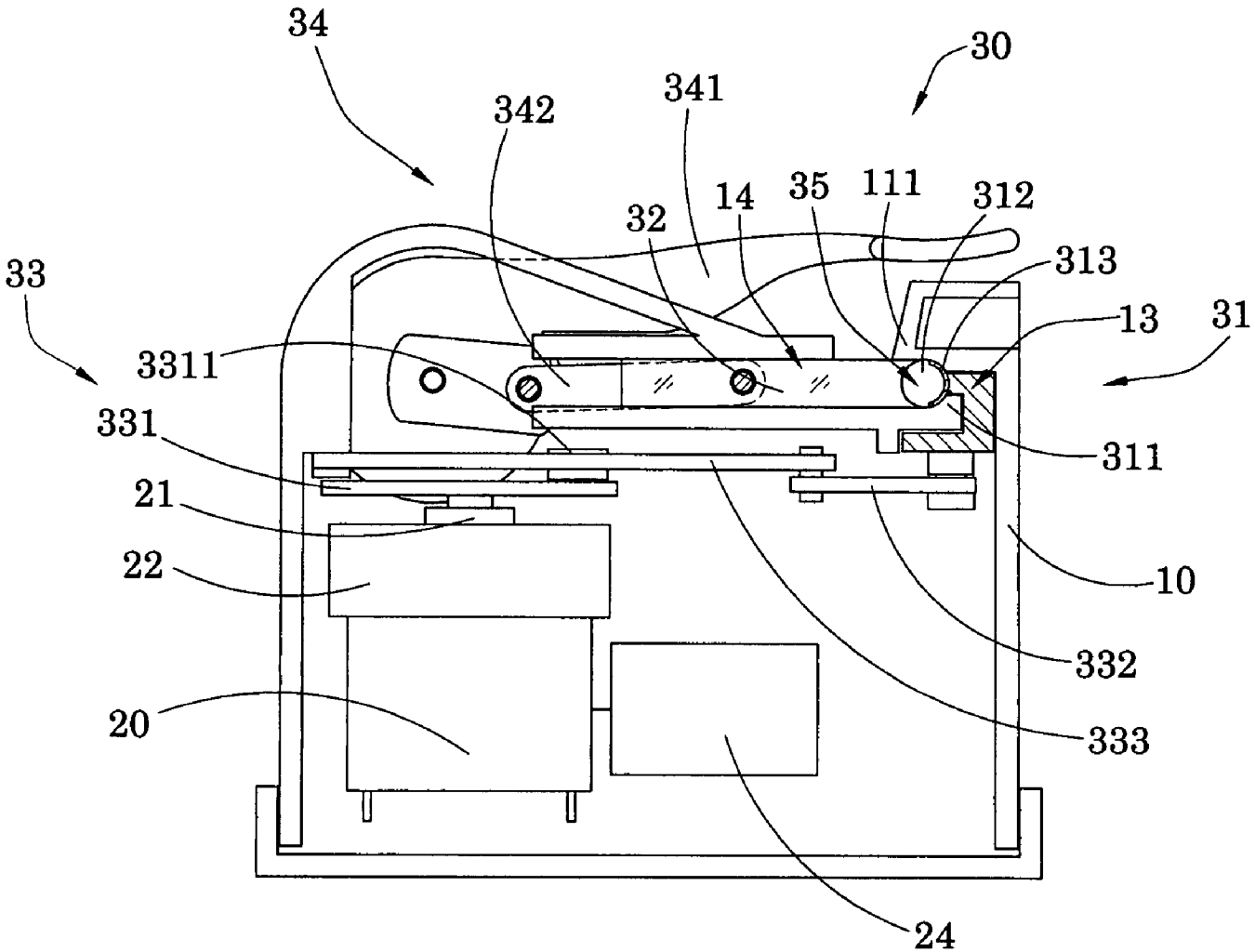
FIG. 3 is a sectional view of the cigarette tube injector according to the above preferred embodiment of the present invention, illustrating the feeding member being slid towards the tobacco feeder.
Figure 4:
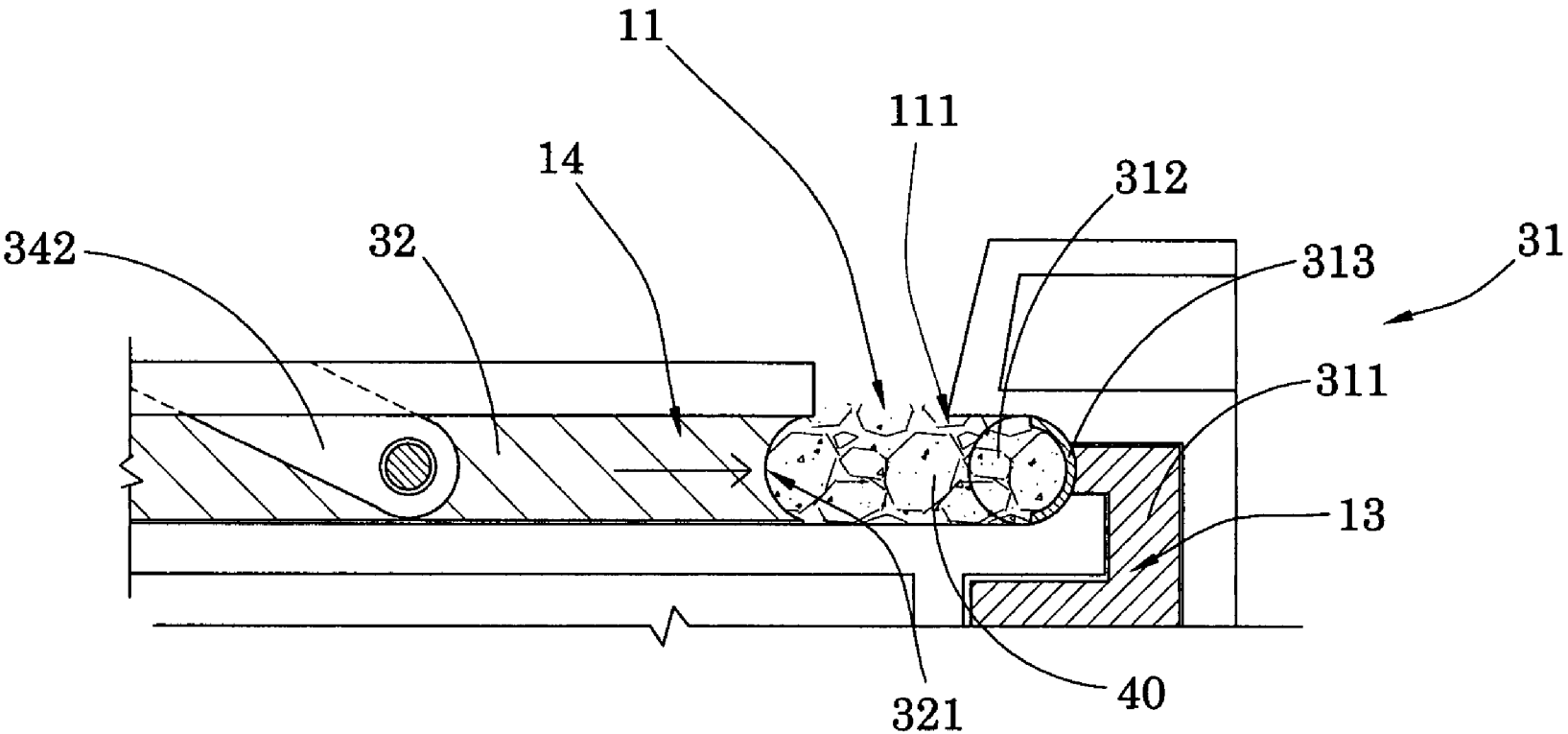
FIG. 4 is a partially sectional view of the feeding member and the tobacco feeder of the cigarette tube injector according to the above preferred embodiment of the present invention.

The housing 10 further comprises a tobacco cavity 11 for tobacco leaves 40 disposing thereat. The length of the tobacco cavity 11 is around the length of the cigarette paper tube 50. Referring to FIGS. 2 to 4, along one longitudinal side of the tobacco cavity 11, the housing 10 comprises a sliding compartment 13. This sliding compartment 13 locates at one longitudinal edge of the tobacco cavity 11. The housing 10 also comprises a guiding compartment 14. This guiding compartment 14 defines the height of the tobacco cavity 11 which is slightly smaller than the diameter of the cigarette paper tube 50. A longitudinal length of the housing 10 is lesser than two cigarette lengths of the cigarette paper tube 50.

The tobacco cavity 11 has an opening on top for deposing the tobacco leaves 40. It also comprises a cutting edge 111 on one side of the opening which is adapted to trim the tobacco leaves 40. The housing 10 also has a feeding opening 12 which is communicatively connected with the tobacco cavity 11. The feeding opening 12 has a tubular holder 121 which is coaxially extended from the feeding opening 12. The tubular holder 121 has a sharpened shape so it is easy to be inserted into the opening of a cigarette paper tube 50. When the opening of a cigarette paper tube 50 encircles the tubular holder 121, the tobacco leaves 40 inside the tobacco cavity 11 can be pushed into the cigarette paper tube 50. The housing 10 also has a tube retainer 122 transversely extended to bias against the tubular holder 121 by means of spring force to retain the cigarette paper tube 50 on the tubular holder 121 during injection.

The electric motor 20 is received in the housing 10 to provide driving power for tobacco injection. The electric motor 20 also comprises an output shaft 21 for generating a rotational power thereat to drive the cigarette filling arrangement 30. In a preferred embodiment, the electric motor 20 also comprises a gearbox 22 to adjust the rotational speed of the output shaft 21 for better performance. The electric motor 20 is powered by a power cable 23, or alternatively by a battery 24 to be portable. In other words, once the battery 24 is charged, the cigarette tube injector is portable to load the loading tobacco leaves 40 into a cigarette paper tube 50.

Referring to FIGS. 2 to 6, the cigarette filling arrangement 30 is driven by the output shaft 21 of the electric motor 20, and is adapted to automatically feed the tobacco leaves 40 from the tobacco cavity 11 to the cigarette paper tube 50 via the feeding opening 12 automatically. The cigarette filling arrangement 30 comprises a tobacco feeder 31, an arc-shaped feeding member 32, a reciprocating unit 33, and a manual actuator 34.

The tobacco feeder 31, which is a feeding crank, is adapted to push the tobacco leaves 40, and it further comprises a driving member 311 which is slidably supported by the sliding compartment 13. The driving member 311 is driven by the reciprocating unit 33 to make a reciprocating movement between a first position and a second position. The first position is located at one end of the sliding compartment 13 which is also at the transverse edge of the tobacco cavity 11, and the second position is located at the opposite end of the sliding compartment 13 which is also at the other transverse edge of the tobacco cavity 11. The second position is also where the feeding opening 12 locates. Because the sliding compartment 13 is at one longitudinal edge of the tobacco cavity 11, the driving member 311 is guided and supported by the sliding compartment 13 to slide between the first position and the second position back and forth linearly along the longitudinal direction of the tobacco cavity 11. The longitudinal direction is also the injection direction.

Referring to FIG. 4, the driving member 311 further comprises a front pusher wall 312. The front pusher wall 312 has a round flat surface facing the feeding opening 12 at the second position. When the driving member 311 is moving from the first position to the second position, the front pusher wall 312 can push the tobacco leaves 40 towards the feeding opening 12 without shredding the tobacco leaves 40. The diameter of the front pusher wall 312 is the same as the height of the tobacco cavity 11. The driving member 311 also comprises an arc-shaped retention member 313. Referring to FIG. 4, the retention member 313 is extended from a circumferential side of the front pusher wall 312 towards the feeding opening 12 along the injection direction. The arc-shape of the retention member 313 is in a semicircular shape. The diameter of the outer wall of the retention member 313 is the same as the front pusher wall 312. The length of the retention member 313 is the same as the length of the sliding compartment 13. The inner wall of the retention member 313 can retain the tobacco leaves 40 within the tobacco cavity 11, and when the driving member 311 is moving to the second position, the retention member 313 will pass through the feeding opening 12, and enter into the cigarette paper tube 50 with the tobacco leaves 40. It is worth mentioning, the arc-shaped retention member 313 has a small thickness so it will not take much tobacco space inside the cigarette paper tube 50.

Figure 5:
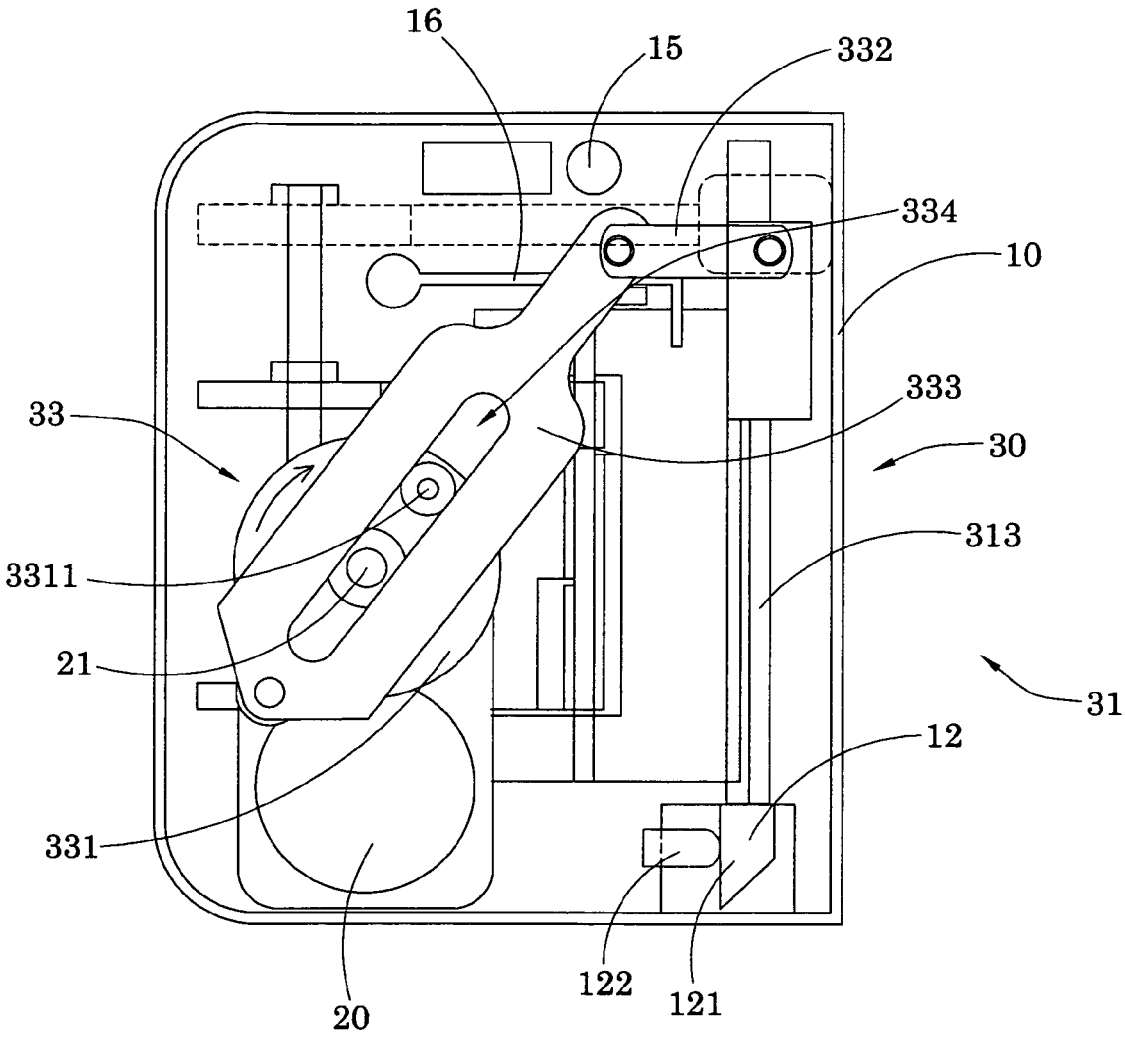
FIG. 5 is a sectional view of the tobacco feeder according to the above preferred embodiment of the present invention, illustrating the tobacco feeder at the first position.

It is worth mentioning, when the driving member 31 is at the first position, referring to FIG. 5, the whole length of the cigarette tube injector is a little longer than the length of a cigarette but lesser than twice of the length of a cigarette.

Referring to FIGS. 2 to 6, a portion of the driving member 311 is extend out of the sliding compartment 13, and is mechanically connected with the reciprocating unit 33. The reciprocating unit 33 is adapted to transmit a rotational power of the output shaft 21 to a sliding movement of the driving member 311 of the tobacco feeder 31. The reciprocating unit 33 comprises a transmission wheel 331 which is coaxially coupled with the output shaft 21 of the electric motor 20. So the output shaft 21 can drive the transmission wheel 331 to rotate. The transmission wheel 331 also comprises an eccentric shaft 3311 which is located on the edge of the transmission wheel 331.

Figure 6:
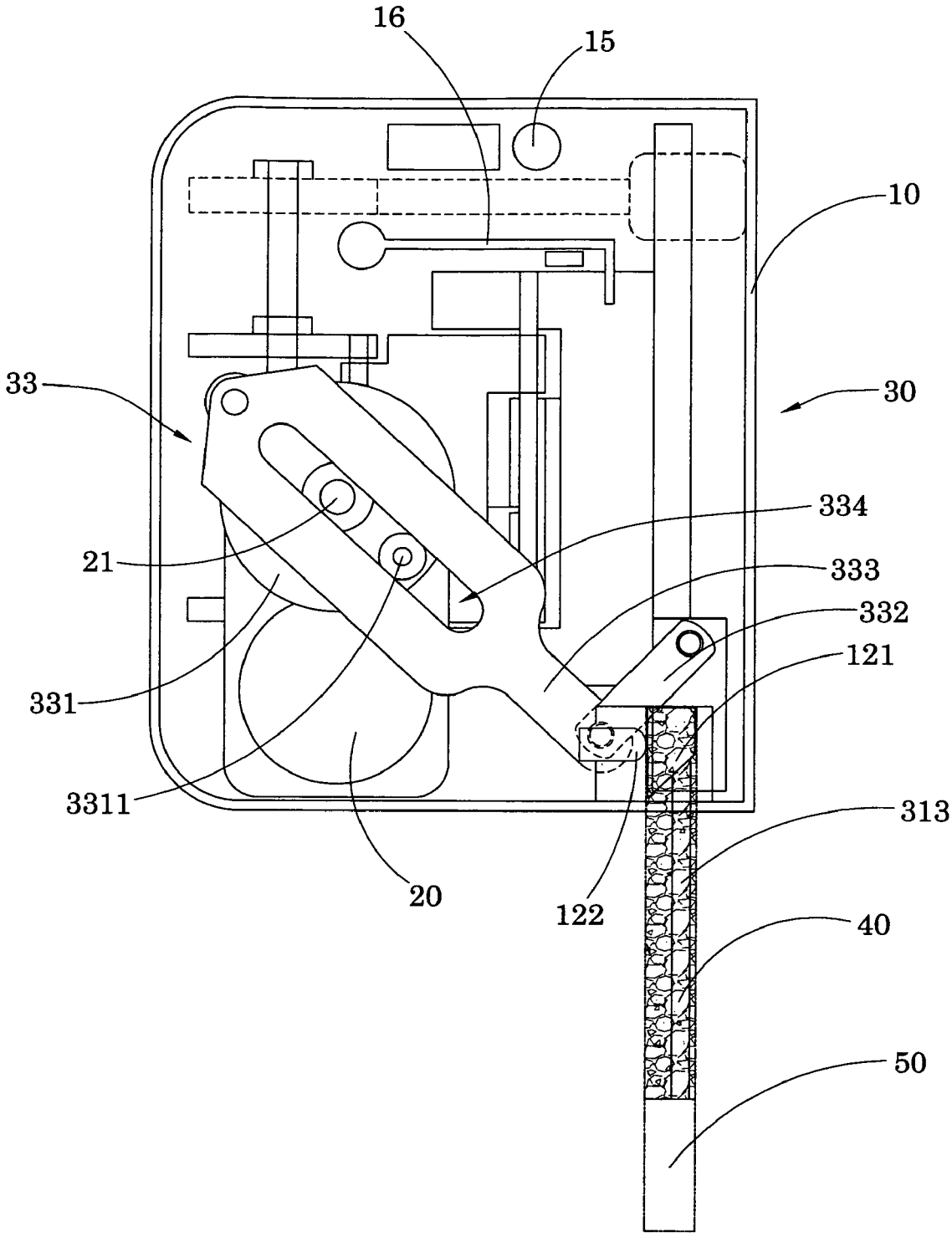
FIG. 6 is a sectional view of the tobacco feeder according to the above preferred embodiment of the present invention, illustrating the tobacco feeder at the second position.

Referring to FIGS. 5 and 6, the reciprocating unit 33 also comprises a connecting arm 332, and a transmission arm 333. The connecting arm 332 is rotatably connected with the driving member 311 and the transmission arm 333 respectively through two pivots. The transmission arm 333 is located over the transmission wheel 331, and has one end pivotally connected with the housing 10, and the other end pivotally connected with the connecting arm 332. The transmission arm 333 also has a transmitting slot 334 which is slidably coupled with the eccentric shaft 3311. When the transmission wheel 331 is driven by the output shaft 21 to rotate, the eccentric shaft 3311 will drive the transmission arm 333 to swing reciprocatingly through the eccentric shaft 3311 and the transmission slot. Then the transmission arm 333 will drive the driving member 311 to move along the sliding compartment 13 to move linearly. In this manner, the rotating movement of the output shaft 21 is transmitted into a linear movement of the driving member 311 between the first position and the second position.

Referring to FIGS. 2 and 3, the arc-shaped feeding member 32 is adapted to push the tobacco leaves 40 towards the arc-shaped retention member 313 and to form a tobacco cylinder, so the front pusher wall 312 of the driving member 311 can push the tobacco cylinder into the cigarette paper tube 50. The feeding member 32 is slidably supported by the guiding compartment 14. The height of the feeding member 32 is the same as the height of the tobacco cavity 11 which is defined by the guiding compartment 14. The feeding member 32 is also driven by the manual actuator 34 to slide along the guiding compartment 14 in a direction perpendicular to the injection direction.

The arc-shaped feeding member 32 has a feeding wall 321 facing the arc-shaped retention member 313 of the tobacco feeder. The feeding wall 321 is also in a semicircular shape which is matched with the retention wall. When the feeding member 32 is push to the driving member 311 of the tobacco feeder, the feeding wall 321 of the feeding member 32 and the retention member 313 of the driving member 311 will be coupled edge-by-edge to form a tubular chamber 35. The tobacco leaves 40 inside the tubular chamber 35 is formed into a tobacco cylinder which will be pushed into the cigarette paper tube 50 by the front pusher wall 312 and the retention member 313 of the driving member 311. This tubular chamber 35 is coaxially aligned with the feeding opening 12.

It is worth mentioning, the diameter of the feeding wall 321 is the same as the diameter of the front pusher wall 312, so the front pusher wall 312 can slide within the feeding wall 321 along the injection direction to push all the tobacco leaves 40 in the tubular chamber 35. Accordingly, the tobacco leaves 40 will not be shredded into pieces when the feeding member 32 is slid to couple with the retention member 313. In addition, when feeding member 32 is slid to couple with the retention member 313, the tobacco leaves 40 will have a uniform compactness within the tubular chamber 35. In other words, the tobacco leaves 40 are loaded within the hollow cigarette paper tube with a uniform and proper compactness by the present invention.

The edge of the feeding wall 321 is sharp. Also, the opening of the tobacco cavity 11 has a sharp cutting edge 111. So when the feeding member 32 is slid to couple with the retention member 313, the sharp cutting edge 111 will trim the tobacco leaves 40.

The manual actuator 34 is for the user to push the feeding member 32 towards the driving member 311 manually. It further comprises a handle member 341 and a pusher unit 342. The handle member 341 is pivotally coupled with the housing 10. The pusher unit 342 is pivotally connected with the handle member 341 at one end, and is pivotally connected with the feeding member 32 at the other end. So when the user presses the handle member 341 downward, the handle member 341 drives the feeding member 32 to slide towards the driving member 311 of the tobacco feeder 31 though the pusher unit 342. When doing this, the feeding member 32 can push the tobacco leaves 40 disposed inside the tobacco cavity 11 towards the driving member 311 and form a tobacco cylinder.

The cigarette tube injector also comprises a start button 15 and a control circuit 16. During operation, the driving member 311 is initially at the first position. The user first load the hollow cigarette paper tube 50 onto the tubular holder 121, then dispose tobacco leaves 40 into the tobacco cavity 11. By pressing the handle member 341, the user can pushes the tobacco leaves 40 towards the driving member 341 of the tobacco feeder 34 through the feeding member 32 to form a tobacco cylinder. Then the user press the start button 15 to start the electric motor 20 to rotate the transmission wheel 331 via the output shaft 21. The control circuit 16 controls the electric motor 20 to rotate the transmission wheel 331 only one revolution. In a preferred embodiment, the control circuit is a contact sensor, when the transmission arm 333 is driven back by the transmission wheel 331 after injecting the tobacco leaves 40, the transmission arm 333 will disconnect the contract sensor, then the electric motor will be shut down. In this way the driving member 341 is driven to slide from the first position to the second position to push the tobacco leaves 40 into the cigarette paper tube 50, and then withdrawn from the second position to the first position, and stopped there waiting for next injection.

Figure 7:
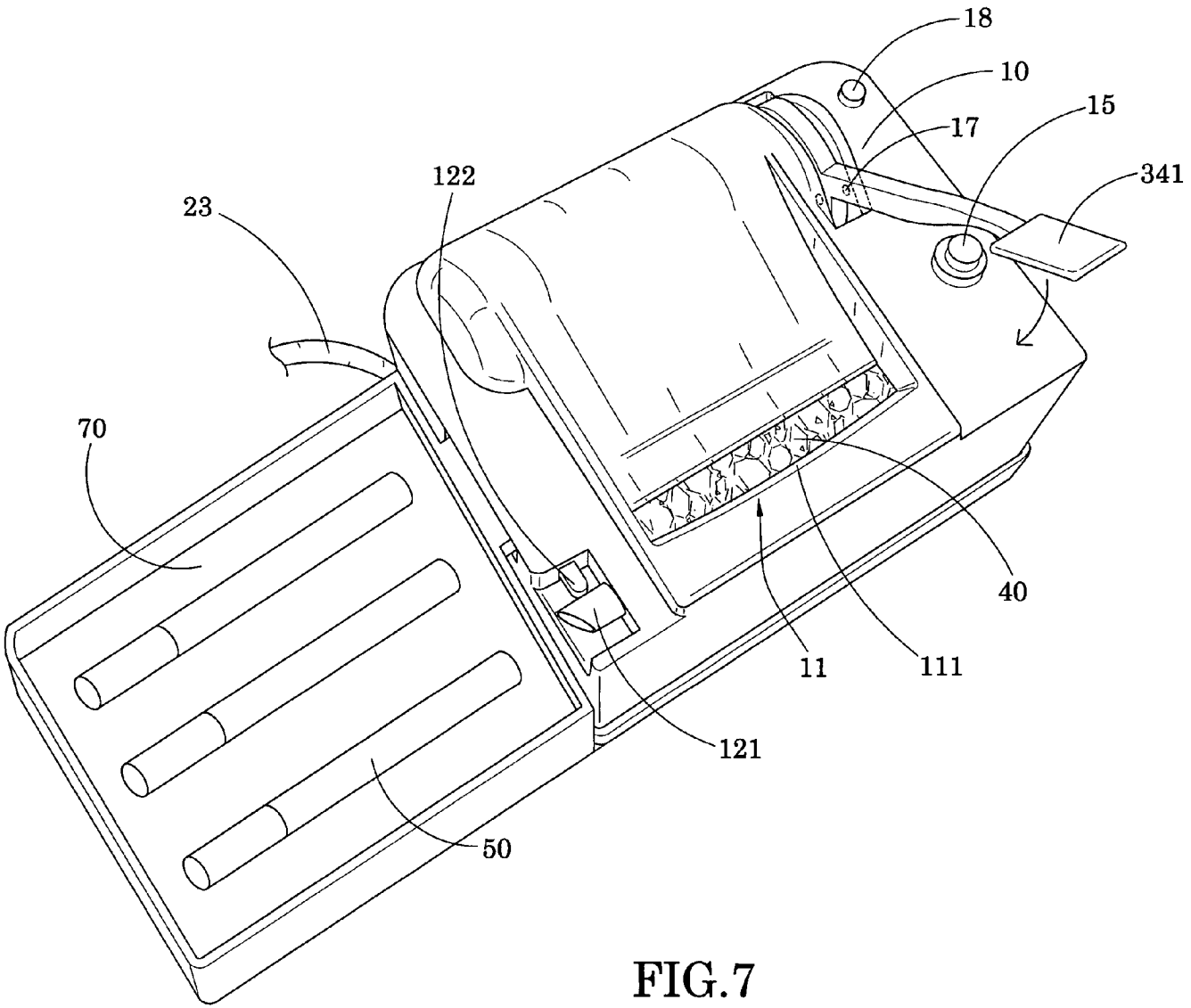
FIG. 7 is a perspective view of the cigarette tube injector according to the above preferred embodiment of the present invention, illustrating the cigarette tray detachably coupling with the housing.

As shown in FIG. 7, the cigarette tube injector, as a modification of the preferred embodiment, further comprises a cigarette tray 60 extending from the bottom of the housing 10 where the feeding opening 12 is located such that the cigarette tray 60 is positioned beneath the tubular holder 121 for receiving the injected cigarette paper tubes 50. In a preferred embodiment, the cigarette tray 60 is detachably attached on the housing 10 such that the cigarette tray 60 can be detached from the housing 10 when the cigarette tube injector is not in use so as to enhance the portability of the present invention. It is appreciated that the cigarette tray 60 can be slidably engaged with the housing 10 such that the cigarette tray 60 can be slid into the housing 10 for storage or can be slid out from the housing 10.

Figure 8:
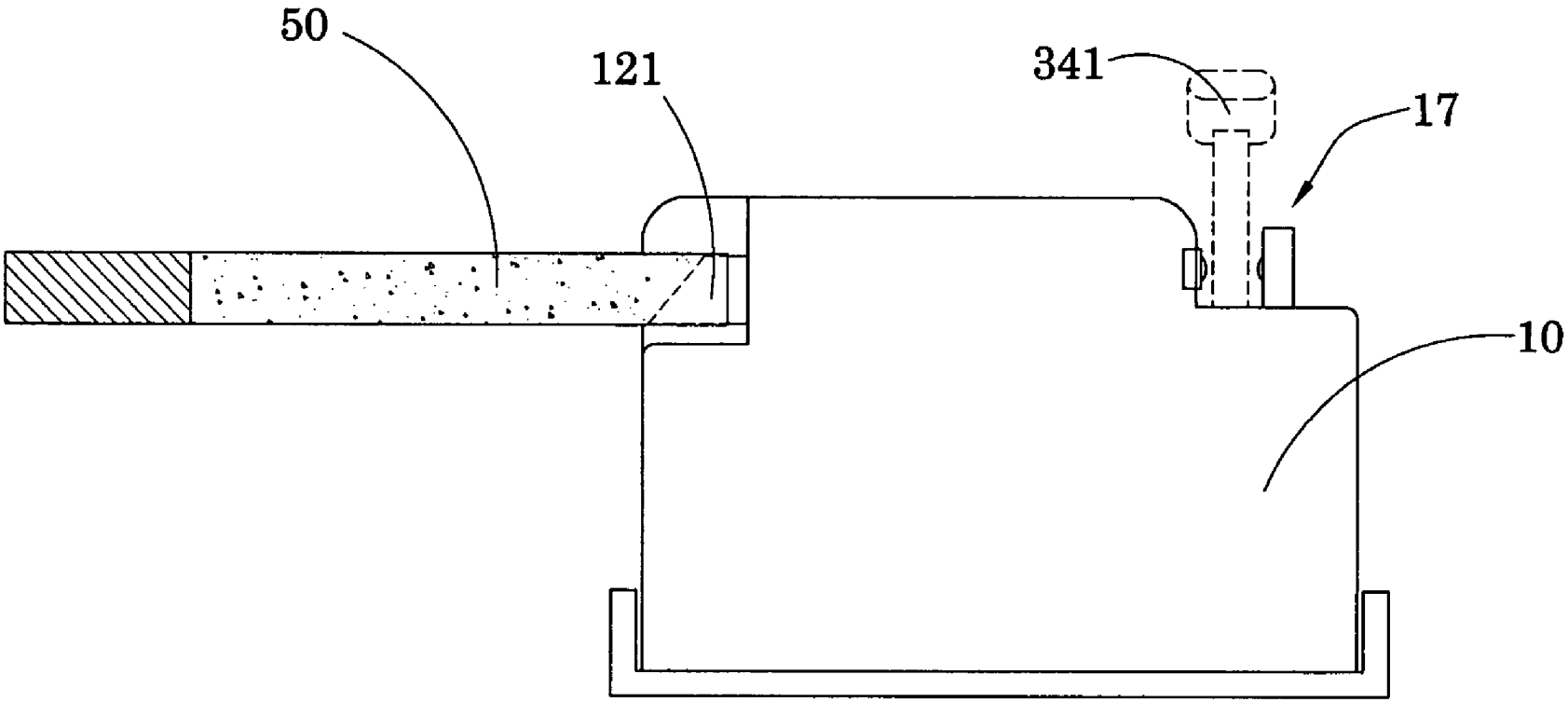
FIG. 8 is a side view of the cigarette tube injector according to the above preferred embodiment of the present invention, illustrating the position sensor incorporating with the handle member.

As shown in FIGS. 7 and 8, the cigarette tube injector may further comprise a position sensor 17, as an optional accessory, for detecting the corresponding position of the manual actuator 34. Accordingly, the position sensor 17 is provided on the top side of the housing 10 at a position adjacent to the handle member 341 and is arranged in such a manner that when the handle member 341 is pivotally moved to drive the feeding member 32 for pushing the tobacco leaves 40 towards the driving member 311, the position sensor 17 is activated to start the electric motor 20. In other words, the position sensor 17 is electrically linked to the control circuit 16 to activate the electric motor 20 such that the position sensor 17 functions as the start button 15 to automatically operate the cigarette filling arrangement 30. Preferably, the position sensor 17 is an optic sensor or a contact sensor to detect the position of the handle member 341. Therefore, the user is able to automatically operate the cigarette tube injector through the position sensor 17 instead of manually pressing the start button 15 to activate the electric motor 20.

A reset control 18 is further provided to operatively link to the cigarette filling arrangement 30 and to electrically link to the control circuit 16, wherein the reset control 18 can be a reset button provided at the top side of the housing 10. Accordingly, the reset control 18 is arranged to reset the initial status of the electric motor 20 when the tobacco feeder 31 is stuck or stopped during the operation. More particularly, when the driving member 311 is driven by the reciprocating unit 33 and is stuck between the first position and the second position, the reset control 18 is actuated to force the electric motor 20 to drive the eccentric shaft 3311 in one complete revolution so as to move the eccentric shaft 3311 back to its initial position. Therefore, the driving member 311 will return back to its original position.

In addition, the reset control 18 further operatively links to the position sensor 17 for ensuring the operation of the cigarette filling arrangement 30 in a safety manner. As it is mentioned above, the position sensor 17 is used for activating the electric motor 20 when the handle member 341 is pivotally and downwardly moved to drive the feeding member 32 for pushing the tobacco leaves 40 towards the driving member 311. Accordingly, when the handle member 341 is pivotally and upwardly moved during the operation of the feeding member 32, the position sensor 17 will detect the operation as a false operation. Therefore, the position sensor 17 will send signal to the reset control 18 through the control circuit 16 to deactivate the electric motor 20 and to force the electric motor 20 to drive the eccentric shaft 3311 in one complete revolution.

Accordingly, the crank type cigarette tube injector of the present invention not only can make a tight and even injection to have a better quality of cigarettes, but also has a reduce dimension and improved portability. The length of the cigarette tube injector is less than two times of the length of a cigarette.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatic cigarette tube injector for injecting tobacco leaves into a hollow cigarette paper tube, comprising:

a housing having a tobacco cavity for said tobacco leaves disposing thereat, and a feeding opening for said cigarette paper tube alignedly supporting thereat, wherein a longitudinal length of said housing is lesser than two cigarette lengths of said cigarette paper tube;

an electric motor, having an output shaft, received in said housing; and a cigarette filling arrangement, which is driven by said electric motor via said output shaft for automatically feeding said tobacco leaves to said cigarette paper tube through said feeding opening of said housing, wherein said cigarette filling arrangement comprises:

a tobacco feeder, which is a feeding crank, longitudinally supported in said housing and driven by said output shaft at a longitudinal direction which is an injection direction;

a retention member for retaining said tobacco leaves from said tobacco cavity;

a feeding member sildably supported in said housing along a direction perpendicularly to said injection direction, wherein said tobacco feeder is able to be slid to couple with said retention member to form a tubular chamber for holding said tobacco leaves therein such that said tobacco feeder is able to be driven to push towards said feeding opening of said housing for feeding said tobacco leaves into said cigarette paper tube; and a reciprocating unit for transmitting a rotational power of said output shaft to a sliding movement of said tobacco feeder, wherein said tobacco feeder is linearly moved at said longitudinal direction out of said feeding opening for feeding said tobacco leaves into said cigarette paper tube and is longitudinally received in said housing to minimize said longitudinal length of said housing which is lesser than two cigarette lengths of said cigarette paper tube.

2. The automatic cigarette tube injector, as recited in claim 1, wherein said tobacco feeder comprises a driving member, having a front pusher wall, being reciprocatingly driven by said output shaft of said electric motor to slide at said housing between a first position and a second position along said injection direction through said feeding opening of said housing, and an arc-shaped retention member frontwardly extended from said front pusher wall of said driving member for retaining said tobacco leaves at an inner wall of said retention member from said tobacco cavity; wherein said feeding member is an arc-shaped feeding member slidably supported in said housing along said direction perpendicularly to said injection direction, wherein said feeding member is slid to couple with said retention member at said first position to form said tubular chamber within said inner wall of said retention member and an inner wall of said feeding member for holding said tobacco leaves within said tubular chamber, such that when said driving member is driven to slide at said second position, said front pusher wall of said driving member is driven to push towards said feeding opening of said housing for feeding said tobacco leaves into said cigarette paper tube.

3. The automatic cigarette tube injector, as recited in claim 2, wherein each of said inner walls of said retention member and said feeding member is formed in a semi-circular shape that when said feeding member is coupled with said retention member to form said tubular chamber, said tubular chamber has a circumferential size corresponding to cigarette paper tube.

4. The automatic cigarette tube injector, as recited in claim 2, wherein at said second position, said retention member is slidably pushed out of said feeding opening of said housing into said cigarette paper tube for loading said tobacco leaves therein.

5. The automatic cigarette tube injector, as recited in claim 2, wherein said reciprocating unit comprises a transmission wheel, having an eccentric shaft, coaxially coupling with said output shaft, a connecting arm rotatably coupling with said driving member, and a transmission arm, having a transmitting slot slidably coupling with said eccentric shaft, rotatably coupling with said connecting arm, such that when said electric motor generates said rotational power at said output shaft, said connecting arm and said transmission arm are driven to move reciprocatingly through said transmission wheel so as to reciprocatingly drive said tobacco feeder to slide between said first and second position.

6. The automatic cigarette tube injector, as recited in claim 2, wherein said housing further has a sliding compartment communicating with said tobacco cavity for said tobacco feeder being slidably supported at said sliding compartment, such that when said tobacco leaves are disposed within said tobacco cavity, said tobacco leaves are filled at said inner wall of said retention member.

7. The automatic cigarette tube injector, as recited in claim 2, wherein said cigarette filling arrangement further comprises a manual actuator for actuating said feeding member being shifted within said tobacco cavity to couple with said retention member, wherein said manual actuator comprises a handle member pivotally coupled with said housing and a pusher unit which is coupled between said handle member and said feeding member and is arranged in such a manner that when said handle member is manually actuated, said feeding member is driven to slide towards said retention member through sad pusher unit.

8. The automatic cigarette tube injector, as recited in claim 7, wherein housing further comprises a guiding compartment longitudinally extended from said tobacco cavity to guide said feeding member to slide towards said retention member.

9. The automatic cigarette tube injector, as recited in claim 2, wherein said retention member is integrally extended from a circumferential side of said driving member such that when said tobacco leaves are retained at said inner wall of said retention member, said front pusher wall of said driving member is driven to push said tobacco leaves towards said feeding opening of said housing.

10. The automatic cigarette tube injector, as recited in claim 9, wherein each of said inner walls of said retention member and said feeding member is formed in a semi-circular shape that when said feeding member is coupled with said retention member to form said tubular chamber, said tubular chamber has a circumferential size corresponding to cigarette paper tube.

11. The automatic cigarette tube injector, as recited in claim 10, wherein said reciprocating unit comprises a transmission wheel, having an eccentric shaft, coaxially coupling with said output shaft, a connecting arm rotatably coupling with said driving member, and a transmission arm, having a transmitting slot slidably coupling with said eccentric shaft, rotatably coupling with said connecting arm, such that when said electric motor generates said rotational power at said output shaft, said connecting arm and said transmission arm are driven to move reciprocatingly through said transmission wheel so as to reciprocatingly drive said tobacco feeder to slide between said first and second position.

12. The automatic cigarette tube injector, as recited in claim 10, wherein at said second position, said retention member is slidably pushed out of said feeding opening of said housing into said cigarette paper tube for loading said tobacco leaves therein.

13. The automatic cigarette tube injector, as recited in claim 12, wherein said housing further has a sliding compartment communicating with said tobacco cavity for said tobacco feeder being slidably supported at said sliding compartment, such that when said tobacco leaves are disposed within said tobacco cavity, said tobacco leaves are filled at said inner wall of said retention member.

14. The automatic cigarette tube injector, as recited in claim 12, wherein said cigarette filling arrangement further comprises a manual actuator for actuating said feeding member being shifted within said tobacco cavity to couple with said retention member, wherein said manual actuator comprises a handle member pivotally coupled with said housing and a pusher unit which is coupled between said handle member and said feeding member and is arranged in such a manner that when said handle member is manually actuated, said feeding member is driven to slide towards said retention member through sad pusher unit.

15. The automatic cigarette tube injector, as recited in claim 14, wherein housing further comprises a guiding compartment longitudinally extended from said tobacco cavity to guide said feeding member to slide towards said retention member.

16. The automatic cigarette tube injector, as recited in claim 12, wherein an opening of said tobacco cavity forms a sharp cutting edge that when said feeding member is slid to couple with said retention member, said sharp cutting edge is adapted for trimming said tobacco leaves to receive in said tubular chamber.

17. The automatic cigarette tube injector, as recited in claim 12, wherein said housing further comprises a tubular holder coaxially extended from said feeding opening for said cigarette paper tube encirclingly retaining with said tubular holder.

18. The automatic cigarette tube injector, as recited in claim 12, wherein said reciprocating unit comprises a transmission wheel, having an eccentric shaft, coaxially coupling with said output shaft, a connecting arm rotatably coupling with said driving member, and a transmission arm, having a transmitting slot slidably coupling with said eccentric shaft, rotatably coupling with said connecting arm, such that when said electric motor generates said rotational power at said output shaft, said connecting arm and said transmission arm are driven to move reciprocatingly through said transmission wheel so as to reciprocatingly drive said tobacco feeder to slide between said first and second position.

19. The automatic cigarette tube injector, as recited in claim 18, wherein said housing further has a sliding compartment communicating with said tobacco cavity for said tobacco feeder being slidably supported at said sliding compartment, such that when said tobacco leaves are disposed within said tobacco cavity, said tobacco leaves are filled at said inner wall of said retention member.

20. The automatic cigarette tube injector, as recited in claim 19, wherein an opening of said tobacco cavity forms a sharp cutting edge that when said feeding member is slid to couple with said retention member, said sharp cutting edge is adapted for trimming said tobacco leaves to receive in said tubular chamber.

21. The automatic cigarette tube injector, as recited in claim 19, wherein said cigarette filling arrangement further comprises a manual actuator for actuating said feeding member being shifted within said tobacco cavity to couple with said retention member, wherein said manual actuator comprises a handle member pivotally coupled with said housing and a pusher unit which is coupled between said handle member and said feeding member and is arranged in such a manner that when said handle member is manually actuated, said feeding member is driven to slide towards said retention member through sad pusher unit.

22. The automatic cigarette tube injector, as recited in claim 21, wherein housing further comprises a guiding compartment longitudinally extended from said tobacco cavity to guide said feeding member to slide towards said retention member.

23. The automatic cigarette tube injector, as recited in claim 22, wherein an opening of said tobacco cavity forms a sharp cutting edge that when said feeding member is slid to couple with said retention member, said sharp cutting edge is adapted for trimming said tobacco leaves to receive in said tubular chamber.

24. The automatic cigarette tube injector, as recited in claim 23, wherein said housing further comprises a tubular holder coaxially extended from said feeding opening for said cigarette paper tube encirclingly retaining with said tubular holder.

25. The automatic cigarette tube injector, as recited in claim 1, wherein said housing further comprises a tubular holder coaxially extended from said feeding opening for said cigarette paper tube encirclingly retaining with said tubular holder.

* * * * *